US007427127B2

(12) United States Patent
Ando et al.

(10) Patent No.: US 7,427,127 B2
(45) Date of Patent: Sep. 23, 2008

(54) HEAD CARTRIDGE AND LIQUID-EJECTING APPARATUS

(75) Inventors: Makoto Ando, Tokyo (JP); Akihito Miyazaki, Kanagawa (JP); Shigeyoshi Hirashima, Kanagawa (JP); Shota Nishi, Kanagawa (JP); Takumi Namekawa, Kanagawa (JP); Masato Nakamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 247 days.

(21) Appl. No.: 10/970,909

(22) Filed: Oct. 22, 2004

(65) Prior Publication Data

US 2005/0116999 A1 Jun. 2, 2005

(30) Foreign Application Priority Data

Oct. 24, 2003 (JP) ..... P2003-364939

(51) Int. Cl.
*B41J 2/175* (2006.01)
*B41J 2/18* (2006.01)

(52) U.S. Cl. ..... 347/85; 347/86; 347/89

(58) Field of Classification Search ..... 347/84–87, 347/89

See application file for complete search history.

(56) References Cited

U.S. PATENT DOCUMENTS 4,432,003 A 2/1984 Barbero et al.
5,220,345 A 6/1993 Hirosawa
5,818,485 A 10/1998 Rezanka
6,585,358 B2 * 7/2003 Usui et al. ..... 347/85
2002/0118256 A1 8/2002 Dixon et al.
2004/0085416 A1 * 5/2004 Kent ..... 347/89

FOREIGN PATENT DOCUMENTS

EP 0 931 662 A2 7/1999
JP 07-266571 10/1995

OTHER PUBLICATIONS

Japanese Office Action issued on Dec. 27, 2007 for Japanese Application No. 2003-364939.

* cited by examiner

*Primary Examiner*—Julian D. Huffman
*Assistant Examiner*—Jason S Uhlenhake
(74) *Attorney, Agent, or Firm*—Sonnenschein Nath & Rosenthal LLP

(57) ABSTRACT

A negative pressure generated inside a liquid-ejecting head can circulate liquid between the liquid-ejecting head and a liquid tank, prevent the liquid from leaking out of nozzles while the liquid is circulating, and remove bubbles contained in the liquid. A head cartridge includes a printhead ejecting ink from ink-ejecting nozzles formed in a nozzle plate of the printhead, an ink-supplying conduit supplying the ink from an ink tank to an ink chamber in the printhead, an ink-refluxing conduit refluxing the ink from the printhead to the ink tank, and a liquid-delivering pump disposed on the ink-refluxing conduit and circulating the ink between the printhead and the ink tank. The liquid-delivering pump is driven to generate a negative pressure inside the printhead to circulate the ink between the printhead and the ink tank.

19 Claims, 9 Drawing Sheets

HEAD CARTRIDGE AND LIQUID-EJECTING APPARATUS

RELATED APPLICATION DATA

The present application claims priority to Japanese Application(s) No(s). P2003-364939 filed Oct. 24, 2003, which application(s) is/are incorporated herein by reference to the extent permitted by law.

BACKGROUND OF THE INVENTION

1. Field of the Invention

The present invention relates to head cartridges ejecting predetermined liquid from liquid-ejecting nozzles formed in the liquid-ejecting heads to targets and to liquid-ejecting apparatuses including the same.

2. Description of the Related Art

Known liquid-ejecting apparatuses such as ink-jet printers print by energizing ejection-driving means such as heating elements and piezoelectric elements disposed in liquid chambers in printheads, and by ejecting drops of predetermined liquid, i.e. ink, in the liquid chambers from ink-ejecting nozzles to recording paper so that the ink drops adhere thereto. Due to advantages such as low unit prices, low running costs, high resolution, and compact bodies, liquid-ejecting apparatuses are in widespread use.

Inside the body, each of the ink-jet printers includes a detachable head cartridge composed of a printhead ejecting ink from ink-ejecting nozzles that are formed in a nozzle plate of the printhead, an ink tank containing the ink that is to be supplied to a liquid chamber in the printhead, an ink-supplying conduit supplying the ink from the ink tank to the printhead, an ink-refluxing conduit refluxing the ink from the printhead to the ink tank, and a liquid-delivering pump for circulating the ink between the printhead and the ink tank.

Such a head cartridge needs to stably eject ink drops in the order of, for example, picoliters from the ink-ejecting nozzles, however, the microscopic ink-ejecting nozzles occasionally cause ink-ejecting failure and impair print quality due to various factors.

One of the factors is bubbles trapped in the printhead and the periphery. When trapped in the ink-supplying conduit or the liquid chamber, the bubbles hinder the stable ink ejection from the ink-ejecting nozzles, and, furthermore, may cause printing failure due to ink nonejection.

Possible sources of the bubbles trapped in the printhead and the periphery include air entering a socket of the ink tank when the ink tank detachable from the printhead is replaced, separation of air that is dissolved in the ink due to changes in temperature or pressure, air entering from the ink-ejecting nozzles due to vibration or impacts during printing or during a halt in printing, air penetrating from conduit members composing ink channels between the ink tank and the printhead, and the like.

These bubbles trapped in the printhead are removed by circulating the ink between the ink tank and the printhead. For example, Japanese Patent No. 2733277 (Page 3, FIG. 16) discloses a technique for ink circulation in which a secondary ink tank is disposed between a main ink tank and a printhead, and a recovery pump delivers ink from the secondary ink tank to the printhead.

Furthermore, Japanese Unexamined Patent Application Publication No. 10-138515 (Page 4, FIG. 1) discloses a technique in which a circulation pump is disposed on an ink-supplying channel extending from an ink tank so as to circulate ink in the ink-supplying channel and in a liquid chamber in a printhead between the ink tank and the printhead, and a head cap that can seal a nozzle plate of the printhead comes into contact with the nozzle plate so as to suck the ink by reducing the pressure inside the head cap.

However, in each of these known techniques, the ink circulates due to a positive pressure applied to the printhead by the pump, and this structure sometimes causes ink leakage from the ink-ejecting nozzles of the printhead during the ink circulation. The leaked ink can contaminate the periphery of the nozzles. Moreover, for a full-line printhead having a large number of nozzles in the nozzle plate over the width of, for example, A4 recording paper, a large volume of the ink leaked from the ink-ejecting nozzles is wasted.

Furthermore, these techniques need solutions for the ink leakage from the ink-ejecting nozzles during the ink circulation. In Japanese Patent No. 2733277, an ink absorbent absorbs the leaked ink. In Japanese Unexamined Patent Application Publication No. 10-138515, the head cap that is brought into contact with the nozzle plate of the printhead sucks the leaked ink. To cope with these solutions, an ink-circulation system to recycle the leaked ink may be employed, however, this may cause upsizing of the apparatuses and an increase in cost.

SUMMARY OF THE INVENTION

To solve the above-mentioned problems, an object of the present invention is to provide a head cartridge and a liquid-ejecting apparatus for preventing liquid from leaking out of the nozzles while the liquid is circulated and for removing bubbles suspended in the liquid by generating a negative pressure inside a liquid-ejecting head so as to circulate the liquid between the liquid-ejecting head and a liquid tank.

In a first aspect of the present invention, a head cartridge includes a liquid-ejecting head ejecting predetermined liquid from liquid-ejecting nozzles formed in a nozzle plate of the liquid-ejecting head; a liquid-supplying conduit supplying the liquid from a liquid tank to a liquid chamber in the liquid-ejecting head; a liquid-refluxing conduit refluxing the liquid from the liquid-ejecting head to the liquid tank; and liquid-circulating means disposed on the liquid-refluxing conduit and circulating the liquid between the liquid-ejecting head and the liquid tank. The liquid-circulating means is driven to generate a negative pressure inside the liquid-ejecting head to circulate the liquid between the liquid-ejecting head and the liquid tank.

In a second aspect of the present invention, a liquid-ejecting apparatus includes a head cartridge detachably disposed in the apparatus body. The head cartridge includes a liquid-ejecting head ejecting predetermined liquid from liquid-ejecting nozzles formed in a nozzle plate of the liquid-ejecting head; a liquid-supplying conduit supplying the liquid from a liquid tank to a liquid chamber in the liquid-ejecting head; a liquid-refluxing conduit refluxing the liquid from the liquid-ejecting head to the liquid tank; and liquid-circulating means disposed on the liquid-refluxing conduit and circulating the liquid between the liquid-ejecting head and the liquid tank. The liquid-circulating means is driven to generate a negative pressure inside the liquid-ejecting head to circulate the liquid between the liquid-ejecting head and the liquid tank. Each of the liquid-ejecting nozzles formed in the liquid-ejecting head of the head cartridge ejects the predetermined liquid to produce a dot or a dot line.

According to these aspects of the present invention, liquid leakage from the liquid-ejecting nozzles during the liquid circulation can be prevented since a positive pressure that forces the ink out of the liquid-ejecting nozzles is not generated in the liquid-ejecting head, and the bubbles suspended in the liquid can be removed. Consequently, the periphery of the nozzles can be prevented from being contaminated by the liquid. Furthermore, since no additional measures are required for the ink leakage, a smaller device can be produced with lower costs.

In the above-described aspects of the present invention, the liquid tank is preferably detachable from the liquid-ejecting head.

Accordingly, the liquid tank can be replaced when the predetermined liquid is exhausted. Therefore, the head cartridge is reusable.

The liquid-circulating means is preferably a liquid-delivering pump.

Accordingly, the ink can be circulated between the liquid-ejecting head and the liquid tank by means of a simple structure.

The liquid-circulating means is preferably driven so as to generate a negative pressure that can maintain a liquid meniscus formed in each of the liquid-ejecting nozzles in the liquid-ejecting head.

As a result, the meniscus in each of the liquid-ejecting nozzles is not destroyed, and therefore air that causes bubbles does not enter the liquid-ejecting head from the liquid-ejecting nozzles.

The head cartridge preferably includes a valve unit having a valve and disposed on the liquid-supplying conduit. The valve unit can supply the liquid from the liquid tank to the liquid-ejecting head by opening the valve when a negative pressure is generated in the liquid-ejecting head.

Accordingly, when the liquid is ejected from the liquid-ejecting nozzles in the liquid-ejecting head, the liquid is supplied from the liquid tank to the liquid-ejecting head. Furthermore, the difference in the pressure can prevent liquid leakage from the liquid-ejecting nozzles during standby of the liquid-ejecting head or when the liquid tank is removed.

The head cartridge preferably includes a valve system disposed in the liquid-circulating means. The valve system can prevent liquid backflow in the direction from the liquid-circulating means to the liquid-ejecting head.

Accordingly, the difference in the pressure can prevent liquid leakage from the liquid-ejecting nozzles during standby of the liquid-ejecting head or when the liquid tank is removed.

The head cartridge preferably includes a valve system disposed on the liquid-refluxing conduit. The valve system can prevent liquid backflow in the direction from the liquid-circulating means to the liquid-ejecting head.

Accordingly, the difference in the pressure can prevent liquid leakage from the liquid-ejecting nozzles during standby of the liquid-ejecting head or when the liquid tank is removed.

The liquid-ejecting head preferably includes a liquid inlet disposed substantially in the center of the liquid-ejecting head and liquid outlets at both ends.

Since this structure causes substantially no dynamic negative pressure loss from the center to both ends of the liquid-ejecting head in the longitudinal direction, the liquid can be stably circulated.

The liquid-ejecting head preferably includes a liquid inlet at one end of the liquid-ejecting head and a liquid outlet at the other end.

Since this structure is simple, the number of parts and man-hours required for assembling can be reduced. Furthermore, the liquid can stably circulate at a constant flow rate on both sides of the liquid-ejecting head in the longitudinal direction.

In a third aspect of the present invention, a liquid-ejecting apparatus includes a liquid-ejecting head ejecting predetermined liquid from liquid-ejecting nozzles formed in a nozzle plate of the liquid-ejecting head; a liquid-supplying conduit supplying the liquid from a liquid tank to a liquid chamber in the liquid-ejecting head; a liquid-refluxing conduit refluxing the liquid from the liquid-ejecting head to the liquid tank; and liquid-circulating means disposed on the liquid-refluxing conduit and circulating the liquid between the liquid-ejecting head and the liquid tank. The liquid-circulating means is driven to generate a negative pressure inside the liquid-ejecting head to circulate the liquid between the liquid-ejecting head and the liquid tank.

According to the third aspect of the present invention, liquid leakage from the liquid-ejecting nozzles during the liquid circulation can be prevented since a positive pressure that forces the ink out of the liquid-ejecting nozzles is not generated in the liquid-ejecting head, and the bubbles suspended in the liquid can be removed. Consequently, the periphery of the nozzles can be prevented from being contaminated by the liquid. Furthermore, since no additional measures are required for the ink leakage, a smaller device can be produced with lower costs.

DESCRIPTION OF THE PREFERRED EMBODIMENTS

Figure 1:
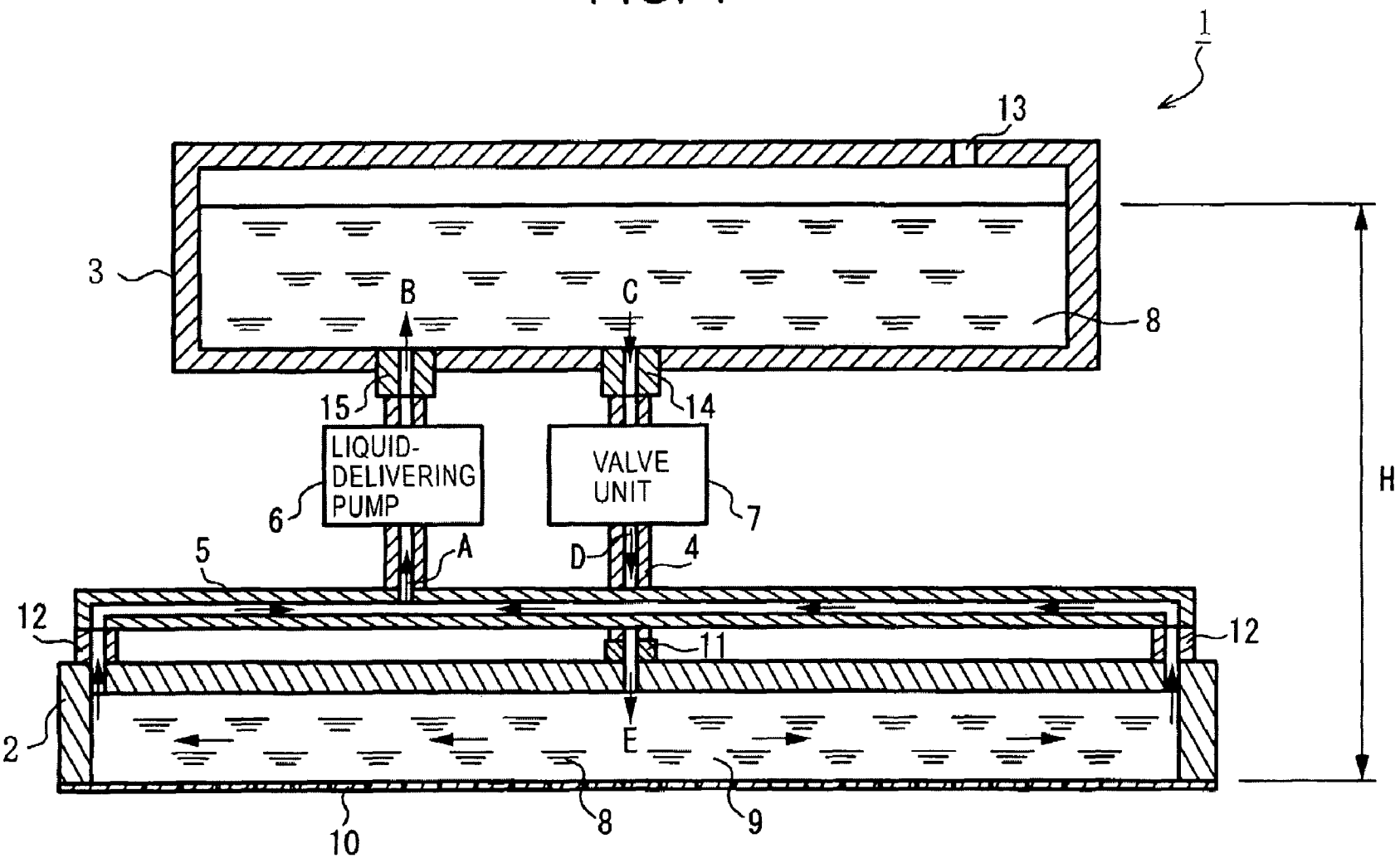
FIG. 1 is a cross-sectional view illustrating a head cartridge according to an embodiment of the present invention.

Embodiments of the present invention will now be described with reference to the drawings. FIG. 1 is a cross-sectional view illustrating a head cartridge according to an embodiment of the present invention. A head cartridge 1 is a device ejecting ink drops to target recording paper and is included in an ink-jet printer, as an example of a liquid-ejecting apparatus. The head cartridge 1 includes a printhead 2, an ink tank 3, an ink-supplying conduit 4, an ink-refluxing conduit 5, a liquid-delivering pump 6, and a valve unit 7.

The printhead 2 is a liquid-ejecting head that ejects predetermined liquid, i.e. ink, to recording paper, and has a common liquid chamber 9 that contains ink 8 to be ejected. A thin nozzle plate 10 of the printhead 2 has many ink-ejecting nozzles (not shown) arranged in lines therein. The printhead 2 herein is of a full-line type having the nozzle plate 10 over the width of, for example, A4 recording paper. The printhead 2 has an ink inlet (liquid inlet) 11 substantially in the center of the upper surface and ink outlets (liquid outlets) 12 at both ends.

The ink tank 3 is disposed above the printhead 2. This ink tank 3 is a box having a predetermined capacity that stores the ink 8 supplied to the common liquid chamber 9 in the printhead 2. The ink tank 3 has a vent 13 bored through the top plate, an ink-outflow hole 14, and an ink-refluxing hole 15 both formed on the bottom plate. The ink-outflow hole 14 and the ink-refluxing hole 15 function as connections with the ink-supplying conduit 4 and the ink-refluxing conduit 5, respectively, and the ink tank 3 is detachable from the printhead 2.

The ink-supplying conduit 4 connects the ink-outflow hole 14 of the ink tank 3 and the ink inlet 11 of the printhead 2. This ink-supplying conduit 4 is a liquid-supplying conduit composed of, for example, a flexible resin tube, and supplies the ink 8 from the ink tank 3 to the printhead 2.

The ink-refluxing conduit 5 connects the ink outlets 12 at both ends of the printhead 2 and the ink-refluxing hole 15 of the ink tank 3. This ink-refluxing conduit 5 is a liquid-refluxing conduit composed of, for example, a flexible resin tube, and refluxes the ink 8 from the printhead 2 to the ink tank 3.

The liquid-delivering pump 6 is disposed at a predetermined position of the ink-refluxing conduit 5. This liquid-delivering pump 6 is liquid-circulating means circulating the ink 8 between the printhead 2 and the ink tank 3, and is composed of a tube pump, a diaphragm pump, a piston pump, or the like that is selected depending on specifications. Thus, an ink-circulating system composed of the ink tank 3, the ink-supplying conduit 4, the printhead 2, the ink-refluxing conduit 5, and the liquid-delivering pump 6 circulates the ink 8 in the directions of arrows shown in FIG. 1.

In the embodiment shown in FIG. 1, the ink 8 in the ink-ejecting nozzles of the nozzle plate 10 has a hydrostatic pressure resulting from the height difference H between the liquid surface of the ink 8 in the ink tank 3 and the nozzle plate 10 of the printhead 2.

Therefore, the ink 8 contained in the common liquid chamber 9 of the printhead 2 naturally leaks out of the nozzles by the action of this hydrostatic pressure. In order to cope with the leakage of the ink 8, the valve unit 7 is disposed at a predetermined position of the ink-supplying conduit 4. This valve unit 7 is normally closed, however, when a negative pressure is generated in the printhead 2, the internal valve of the valve unit 7 is opened to supply the ink 8 from the ink tank 3 to the printhead 2.

Figure 2:
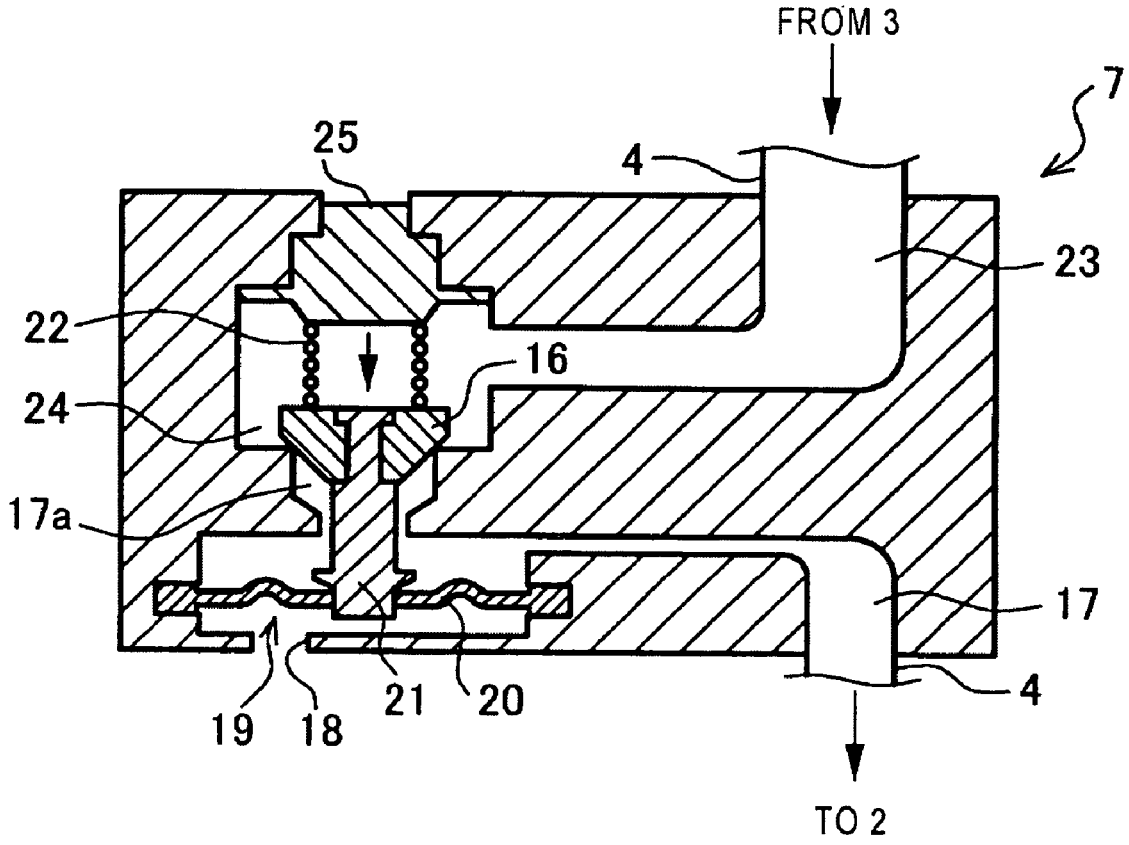
FIG. 2 is a cross-sectional view illustrating the internal structure and the operation of the valve unit shown in FIG. 1 in which a valve disposed inside the valve unit is closed.
Figure 3:
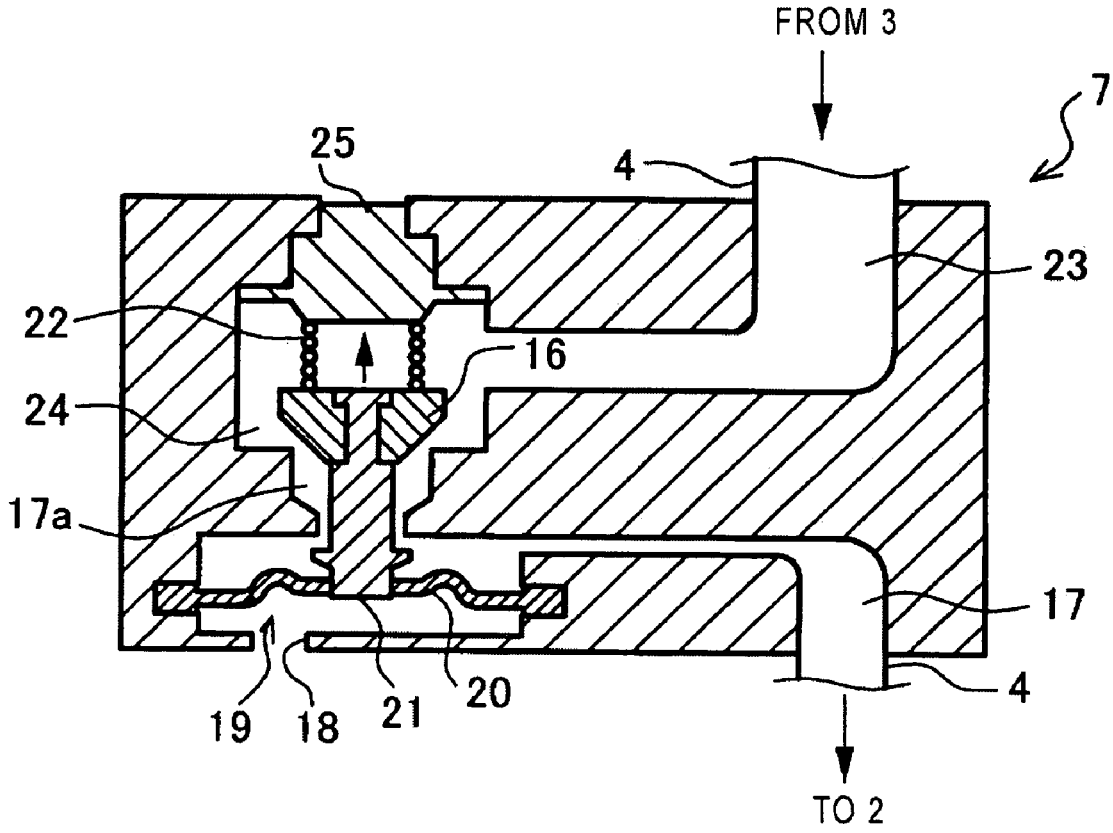
FIG. 3 is a cross-sectional view illustrating the internal structure and the operation of the valve unit shown in FIG. 1 in which the valve disposed inside the valve unit is open.

Referring to FIGS. 2 and 3, the structure and the operation of the valve unit 7 will now be described. A valve 16 disposed inside the valve unit 7 is closed in FIG. 2, whereas the valve 16 is open in FIG. 3.

In FIG. 2, the printhead 2 shown in FIG. 1 is not ejecting ink. The pressure in an ink-outflow channel 17 connected to the ink-supplying conduit 4 that leads to the printhead 2 is in a steady state, and equals the ambient pressure applied to an outward opening 18 formed in the bottom of the valve unit 7. At this moment, a diaphragm 20 stretched in a diaphragm chamber 19 is in a neutral state. The valve 16 is disposed on the top portion of a valve shaft 21 projecting upwards from the diaphragm 20, and is urged downwards by a coiled spring 22 connected to the top surface of the valve 16 so as to close a flow path 17*a* in the ink-outflow channel 17.

In this manner, an ink chamber 24 is isolated to prevent the natural leakage of the ink 8 contained in the common liquid chamber 9 of the printhead 2 regardless of the hydrostatic pressure caused by the height difference H shown in FIG. 1.

When the printhead 2 shown in FIG. 1 ejects the ink 8 from the ink-ejecting nozzles while the valve 16 shown in FIG. 2 is closed, a negative pressure is generated adjacent to the printhead 2 to reduce the pressure inside the ink-outflow channel 17 connected to the ink-supplying conduit 4 that leads to the printhead 2. Accordingly, the pressure inside the ink-outflow channel 17 becomes lower than the ambient pressure applied to the outward opening 18, and the diaphragm 20 in the diaphragm chamber 19 elastically deforms upwards as shown in FIG. 3 according to the pressure difference.

The valve shaft 21 projecting from the diaphragm 20 is then lifted against the urging force of the coiled spring 22, and the valve 16 disposed on the top portion of the valve shaft 21 is also lifted to open the flow path 17*a* in the ink-outflow channel 17. Accordingly, as shown in FIG. 3, an ink-inflow channel 23 connected to the ink-supplying conduit 4 into which the ink flows from the ink tank 3 communicates with the ink-outflow channel 17 at the ink chamber 24. Due to suction caused by the pressure drop inside the ink-outflow channel 17, the ink 8 flows into the ink chamber 24 through the ink-inflow channel 23, and flows out from the ink chamber 24 through the ink-outflow channel 17. In this manner, the ink 8 is supplied from the ink tank 3 to the printhead 2 shown in FIG. 1.

When the pressure inside the ink-outflow channel 17 shown in FIG. 3 returns to the steady state after the ink 8 is supplied from the ink tank 3 to the printhead 2, the pressure inside the ink-outflow channel 17 becomes equal to the ambient pressure applied to the outward opening 18, and the pressure difference therebetween disappears. Accordingly, as shown in FIG. 2, the diaphragm 20 deforms downwards due to the restoring force and returns to the neutral state. As a result, the valve shaft 21 is pushed down due to the urging force of the coiled spring 22, and the valve 16 disposed on the top portion of the valve shaft 21 is also pushed down to close the flow path 17*a* in the ink-outflow channel 17. In this manner, the supply of the ink 8 from the ink tank 3 to the printhead 2 is halted.

The valve unit 7 shown in FIG. 1 repeats the above-described operation for supplying ink every time the ink 8 is ejected from the ink-ejecting nozzles in the printhead 2. In FIGS. 2 and 3, the reference numeral 25 indicates an adjusting screw adjusting the timing of opening and closing the valve 16 in response to the negative pressure generated adjacent to the printhead 2.

The ink-circulating operation for removing bubbles that are suspended in the ink 8 in the above-described head cartridge 1 will now be described with reference to FIG. 1. Such an ink-circulating operation is conducted, for example, at start-up (switch-on) of an ink-jet printer including the head cartridge 1, before printing, at a predetermined paper count of printing, and at a predetermined time period.

When the liquid-delivering pump 6 disposed at a predetermined position of the ink-refluxing conduit 5 is driven, the ink 8 in the ink-refluxing conduit 5 is sucked in the direction of an arrow A. The ink 8 in the printhead 2 is also sucked from the ink outlets 12 at both ends of the printhead 2 to flow into the liquid-delivering pump 6.

According to this driving of the liquid-delivering pump 6, the ink 8 is sent from the ink-refluxing hole 15 into the ink tank 3 in the direction of an arrow B. Thus, the ink 8 flows from the ink outlets 12 in the printhead 2 toward the ink tank 3 through the ink-refluxing conduit 5.

The pressure inside the common liquid chamber 9 is reduced due to the outflow of the ink 8 from the printhead 2.

As described with reference to FIG. 3, the valve 16 in the valve unit 7 is then opened such that the ink 8 contained in the ink tank 3 flows toward the valve unit 7 in the direction of an arrow C, through the ink-supplying conduit 4 in the direction of an arrow D, and from the ink inlet 11 provided in the center of the printhead 2 into the printhead 2 in the direction of an arrow E. In this manner, the ink 8 in the printhead 2 is sucked in the direction of the arrow A to flow into the ink tank 3 in the direction of the arrow B, and the ink 8 in the ink tank 3 flows to the printhead 2 in the directions of the arrows of C, D, and E. Thus, the ink 8 circulates between the printhead 2 and the ink tank 3 according to the driving of the liquid-delivering pump 6.

During this circulation, the ink 8 in the printhead 2 flows from the center toward both ends, and bubbles in the printhead 2 are moved from the ink outlets 12 at both ends of the printhead 2 into the ink-refluxing conduit 5, and subsequently from the ink-refluxing hole 15 into the ink tank 3. The bubbles are then discharged from the vent 13 bored through the top plate of the ink tank 3. Accordingly, the bubbles suspended in the ink 8 are removed.

Unlike a known positive-pressure system that pumps ink into a printhead, this negative-pressure system, which sucks the ink 8 in the printhead 2 according to the driving of the liquid-delivering pump 6 so as to circulate the ink 8, can prevent the ink 8 from leaking out of the ink-ejecting nozzles in the printhead 2. Consequently, the negative-pressure system can prevent the ink 8 from contaminating the periphery of the nozzles, and also prevent the ink 8 from being wasted. Furthermore, since no additional measures are required for the ink leakage, a smaller device can be produced with lower costs.

However, when the sucking pressure according to the driving of the liquid-delivering pump 6 is excessively high in the ink circulation of the negative-pressure system according to the present invention, the ink may not be ejected due to bubbles caused by air that is sucked from the ink-ejecting nozzles in the printhead 2. Therefore, the liquid-delivering pump 6 may be driven so as to generate a negative pressure that can maintain an ink meniscus formed in each of the ink-ejecting nozzles in the printhead 2.

In general, when a nozzle having a particular area is filled with liquid, a pressure P for maintaining the meniscus in the nozzle is given by:

$$P=\gamma l \cos(\theta)/A$$

where γ is the surface tension of the liquid, l is the peripheral length of the nozzle, θ is the contact angle of the liquid to the inner wall of the nozzle, and A is the area of the nozzle. When the diameter of the nozzle is d, the pressure P for maintaining the meniscus of the ink 8 in each of the ink-ejecting nozzles in the printhead 2 is given by:

$$P=4\gamma \cos(\theta)/d$$

For example, when the nozzle diameter is 17 μm, the surface tension of the ink 8 is 30 mN/m, and the contact angle is approximately 5°, the pressure P for maintaining the meniscus is approximately 740 $mmH_2O$. In this case, when the negative pressure generated by the liquid-delivering pump 6 is approximately 740 $mmH_2O$ or less, the meniscus in each of the ink-ejecting nozzles is maintained and air that causes bubbles does not enter the printhead 2.

Even if the negative pressure according to the driving of the liquid-delivering pump 6 exceeds approximately 740 $mmH_2O$, air that causes bubbles does not enter the printhead 2 as long as the sum of the negative pressure and a pressure loss caused by the channel resistance in the ink channel from the liquid-delivering pump 6 to the ink-ejecting nozzles does not exceed the pressure for maintaining the meniscus. When the sucking pressure of the liquid-delivering pump 6 is too high to suck air from the ink-ejecting nozzles, a pressure adjuster 26 shown in FIG. 4 composed of, for example, a throttle unit, may be disposed on the ink-refluxing conduit 5 between the liquid-delivering pump 6 and the printhead 2 in order to control the pressure for maintaining the meniscus in each nozzle.

Figure 5:
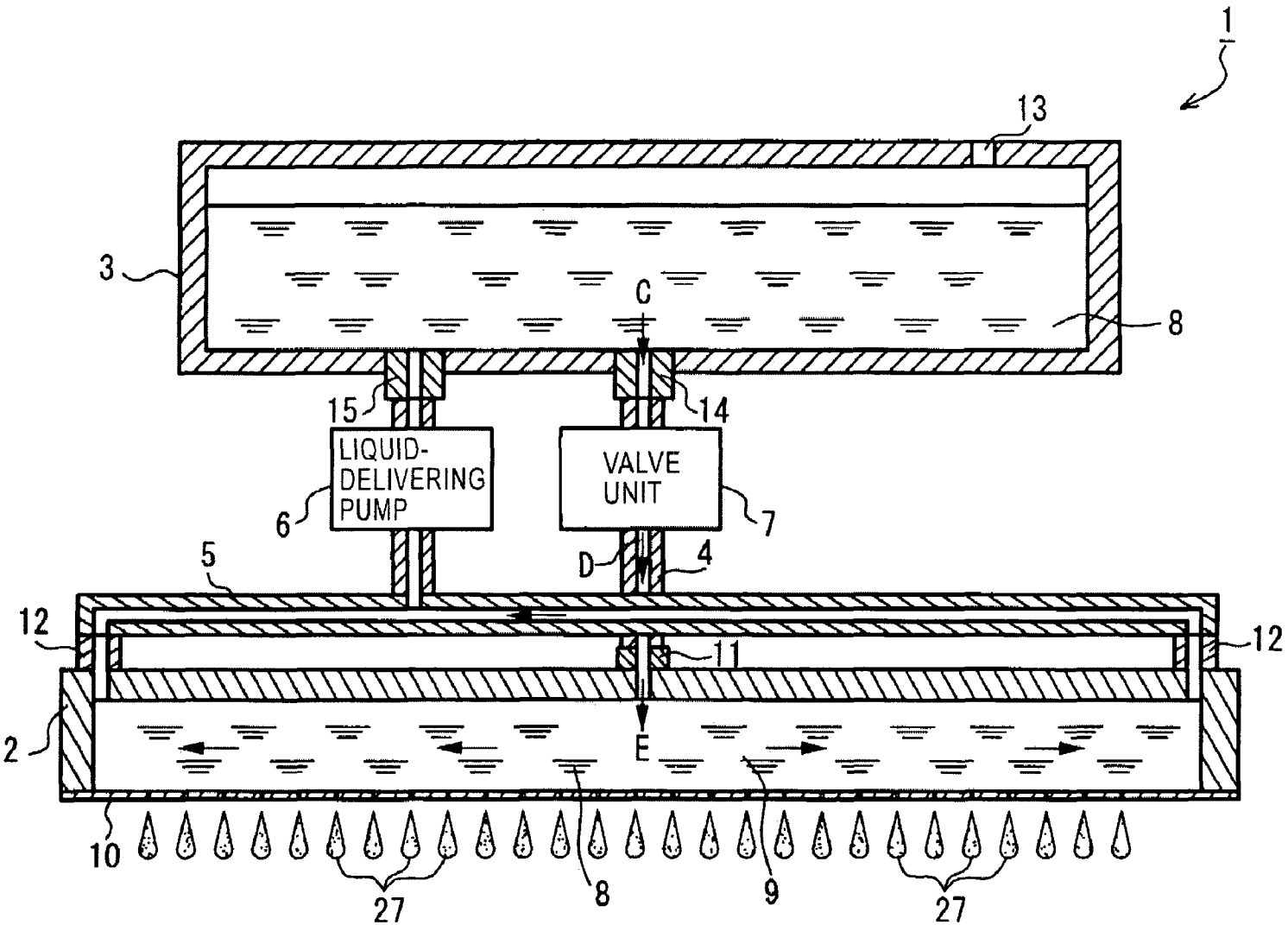
FIG. 5 illustrates the ink flow in the head cartridge according to the present invention while ink is ejected.

FIG. 5 illustrates the ink flow in the head cartridge 1 according to the present invention while the ink 8 is being ejected. As described with reference to FIGS. 2 and 3, during printing, the valve 16 in the valve unit 7 is opened due to the negative pressure in the printhead 2 caused by the ejection of the ink 8, and the ink 8 is supplied from the ink tank 3 to the printhead 2 through the ink-supplying conduit 4 in the directions of the arrows of C, D, and E. The ink-ejecting nozzles eject ink drops 27 to recording paper for printing according to the driving of ejection-driving means such as heating elements or piezoelectric elements disposed in liquid compartments communicating with the respective ink-ejecting nozzles.

Every time the ink-ejecting nozzles in the printhead 2 eject the ink drops 27, the valve 16 in the valve unit 7 is opened, and the ink 8 is supplied from the ink tank 3 in the direction of the arrows C, D, and E.

The liquid-delivering pump 6 has a valve system such as a check valve to prevent the ink 8 from flowing backwards from the liquid-delivering pump 6 to the printhead 2 during the printing operation shown in FIG. 5. When the liquid-delivering pump 6 does not have a check valve therein, a check valve 28 shown in FIG. 6 may be disposed on the ink-refluxing conduit 5 between the liquid-delivering pump 6 and the printhead 2. Such a valve system for backflow prevention may be an electromagnetic valve or a mechanical valve, for example, a so-called duckbill valve, that passively opens and closes in response to the pressure of the ink 8 in the conduit.

The valve system for the backflow prevention is also required during standby for printing and when the ink tank 3 is removed. During standby, the ink 8 in the ink-ejecting nozzles has the hydrostatic pressure caused by the height difference H between the ink tank 3 and the printhead 2. When the ink tank 3 is removed, the connection to the ink tank 3, i.e. the portion of the ink-refluxing hole 15, is open to air and is subjected to the ambient pressure. Consequently, in the absence of the valve system for the backflow prevention, the ink 8 leaks out of the ink-ejecting nozzles in the printhead 2.

Figure 7:
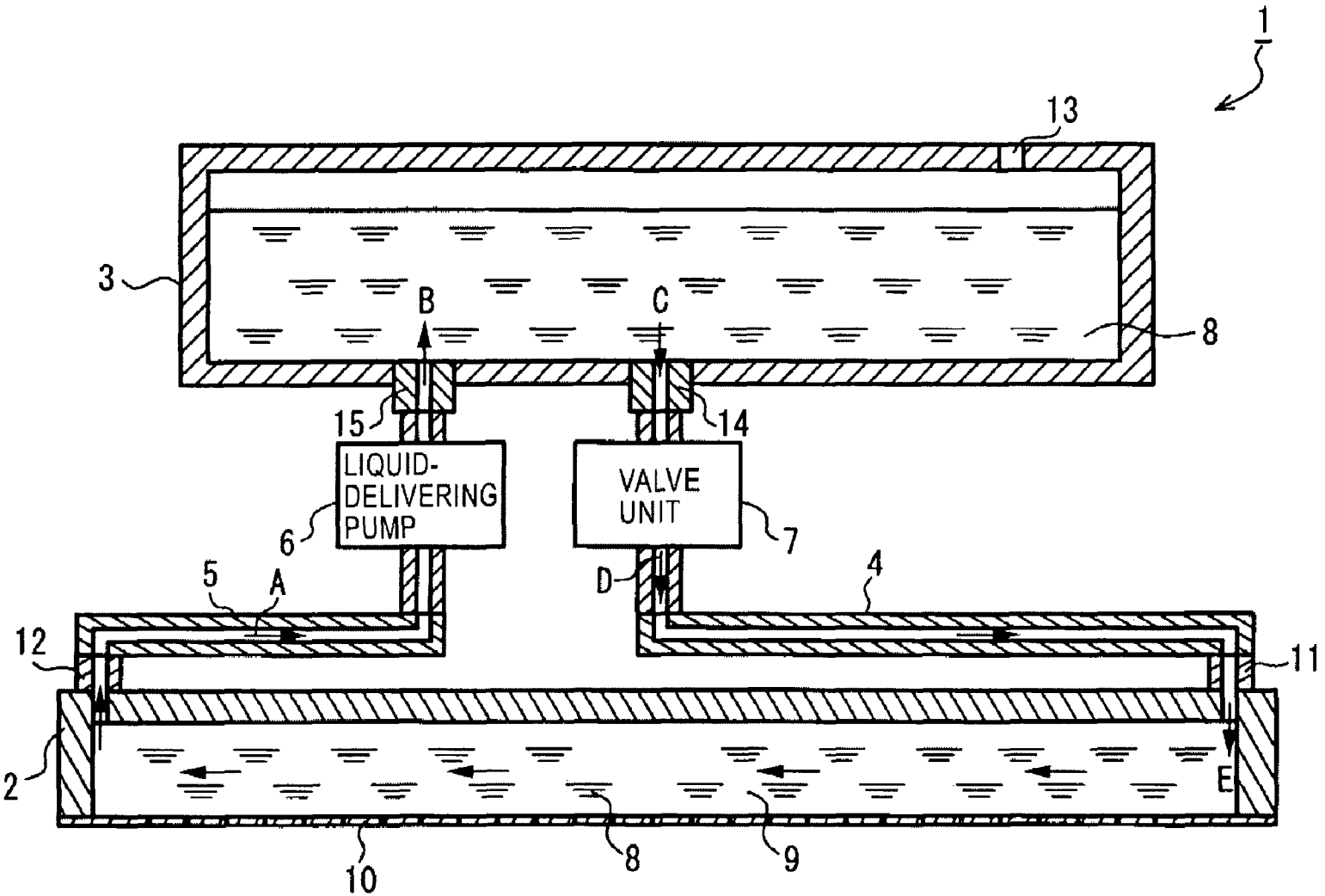
FIG. 7 is a cross-sectional view illustrating a head cartridge according to a fourth embodiment of the present invention.

FIG. 7 is a cross-sectional view illustrating a head cartridge according to another embodiment of the present invention. In this embodiment, the printhead 2 has the ink inlet 11 at one end and the ink outlet 12 at the other end. The ink inlet 11 is connected to the ink-supplying conduit 4 extending from the ink tank 3, and the ink outlet 12 is connected to the ink-refluxing conduit 5 extending to the ink tank 3.

Figure 4:
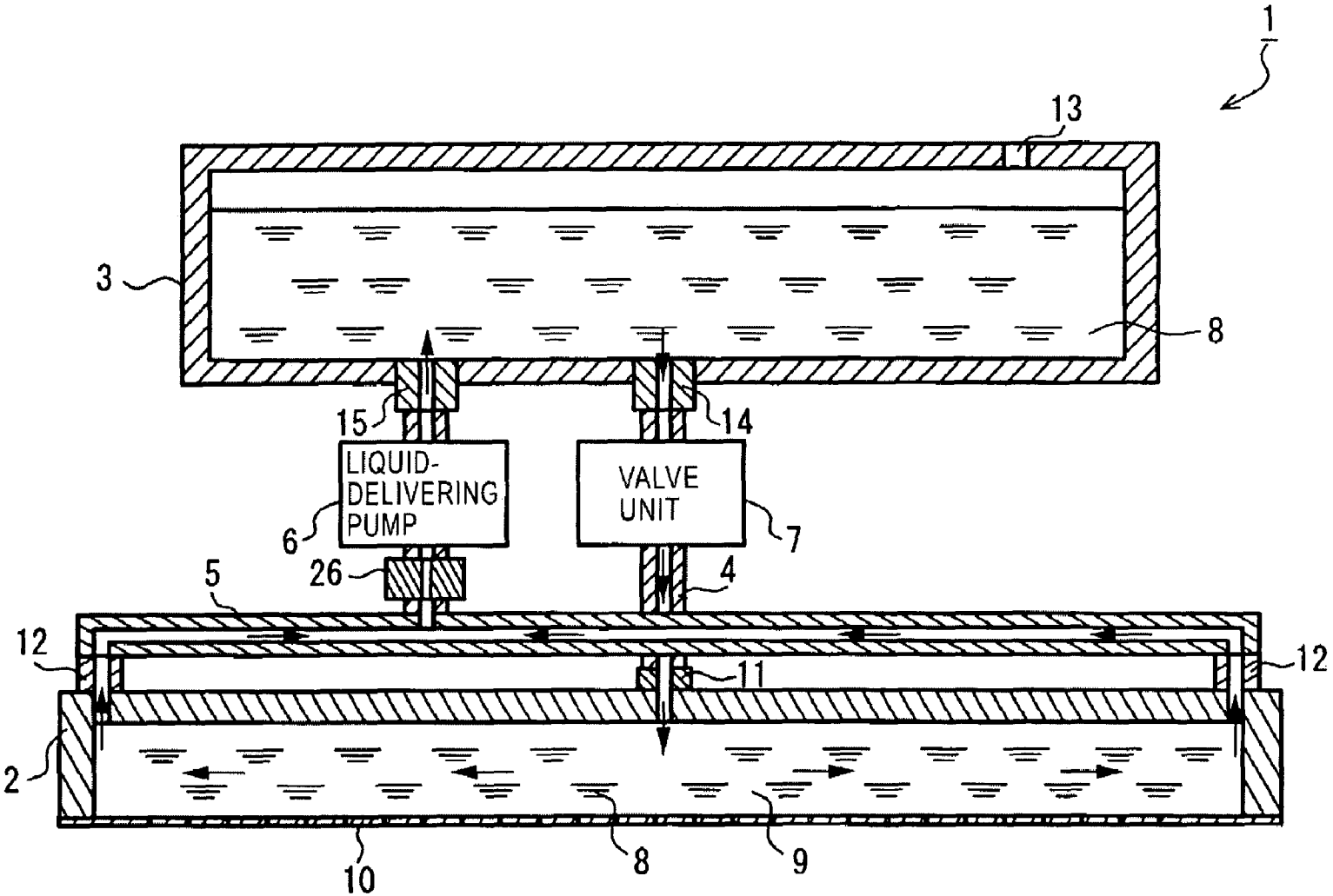
FIG. 4 is a cross-sectional view illustrating a head cartridge according to a second embodiment of the present invention.
Figure 6:
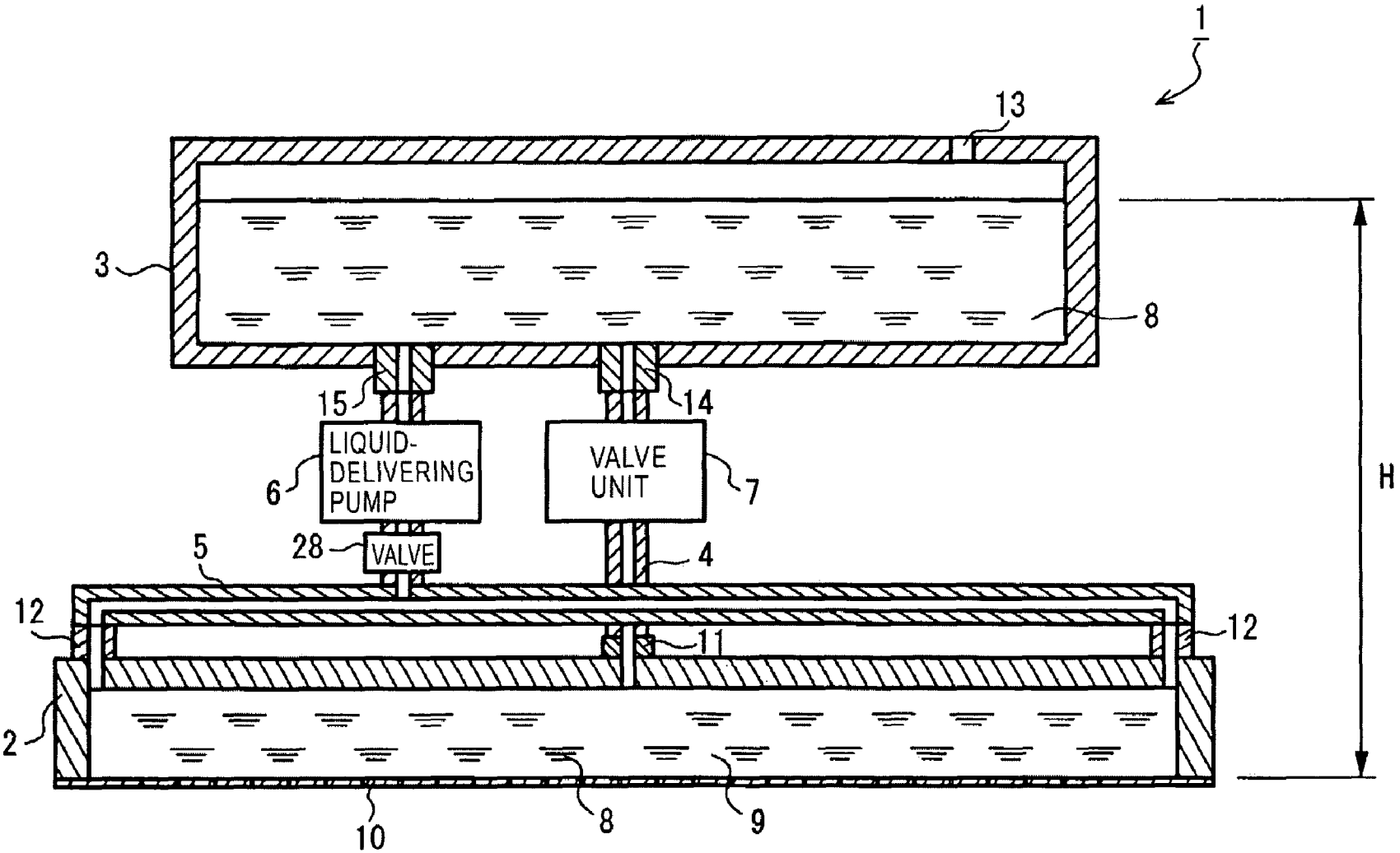
FIG. 6 is a cross-sectional view illustrating a head cartridge according to a third embodiment of the present invention.

According to the negative-pressure system for removing the bubbles suspended in the ink 8, the ink 8 flows in the direction of the arrows A, B, C, D and E. In this case, the structure is simpler than the embodiment shown in FIG. 1, and thus the number of parts and man-hours required for assembling can be reduced. Furthermore, since the ink 8 in the printhead 2 flows in one direction from the ink inlet 11 to the ink outlet 12, the ink can stably circulate at a constant flow rate on both sides of the printhead 2 in the longitudinal direction. Also in this embodiment shown in FIG. 7, the pressure adjuster 26 may be disposed on the ink-refluxing conduit 5 as shown in FIG. 4, or the check valve 28 may be disposed on the ink-refluxing conduit 5 as shown in FIG. 6.

In the above-described embodiments, the printhead 2 is of a full-line type having the nozzle plate 10 of the printhead 2 over the width of recording paper. However, the present invention is not limited to the above-described embodiments, and a serial printhead having the nozzle plate 10 shorter than the width of the recording paper and reciprocating in the width direction is also applicable to the printhead 2. Moreover, when the ink tank 3 is disposed below the printhead 2 in FIG. 1, the valve unit 7 is not necessary.

An ink-jet printer as an example of a liquid-ejecting apparatus according to an embodiment of the present invention will now be described with reference to FIGS. 8, 9A and 9B. An ink-jet printer 30 ejects ink drops from the head cartridge 1 toward target recording paper at predetermined positions to produce images. The ink-jet printer 30 includes a printer body 31, the head cartridge 1, and a paper tray 32.

The printer body 31 accommodates paper-feeding mechanisms and electrical circuits for optimized printing onto the recording paper. The printer body 31 includes an open storage unit 33 for accommodating the head cartridge 1, and a top cover 34 on the top for opening and closing the storage unit 33. The printer body 31 further includes a tray-loading slot 35 in the lower front for loading the paper tray 32 (described below). This tray-loading slot 35 also functions as a paper-delivering slot. The printer body 31 has a display panel 31*a* in the upper front for displaying the status of operation of the ink-jet printer 30.

The head cartridge 1 having a structure shown in any one of FIGS. 1 to 7, which is detachable from the storage unit 33, is accommodated in the storage unit 33 of the printer body 31 in the direction of an arrow Z. This head cartridge 1 includes the printhead 2 ejecting ink from the ink-ejecting nozzles that are provided in the nozzle plate, and the ink tanks 3 containing multiple color inks such as yellow (Y), magenta (M), cyan (C), and black (K) that are supplied to the respective liquid chambers in the printhead 2. The printhead 2 has a head cap 41 disposed on the underside. The printhead 2 shown herein as an example is of a full-line type having the nozzle plate over the width of, for example, A4 recording paper.

The paper tray 32 accommodates a stack of recording paper, and is detachably loaded in the tray-loading slot 35 of the printer body 31. An output tray 32*a* for recording paper that is output from the printer body 31 is disposed on the top surface of the paper tray 32.

Figure 9A:
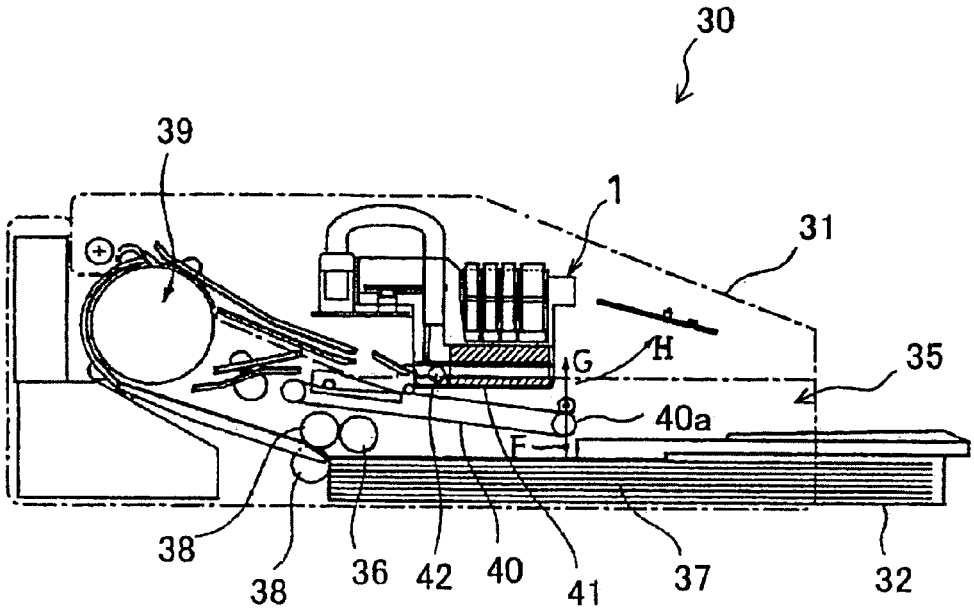
FIG. 9A is a cross-sectional view illustrating the internal structure of the ink-jet printer shown in FIG. 8 while printing operation is halted.
Figure 9B:
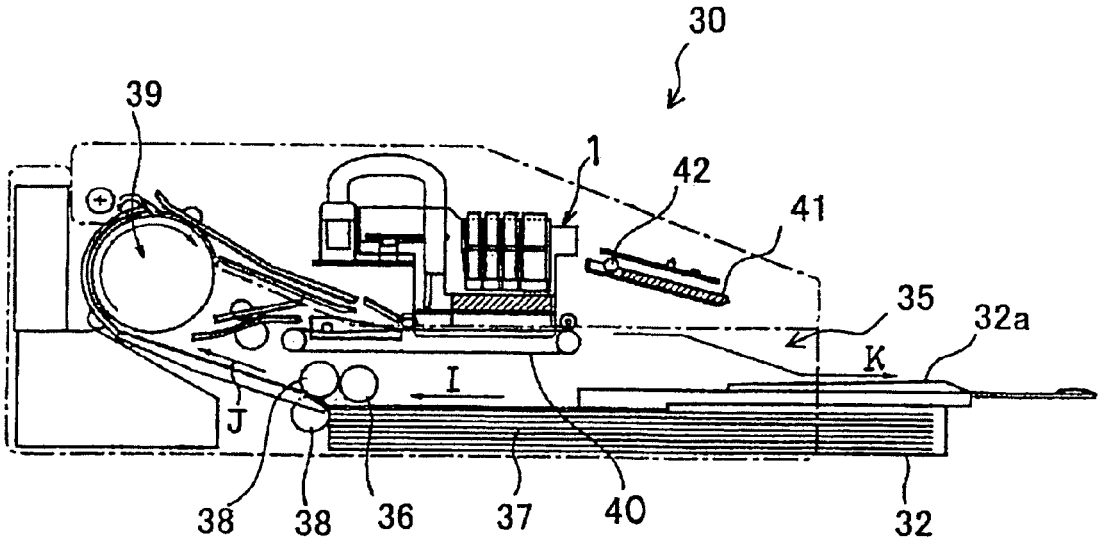
FIG. 9B is a cross-sectional view while printing operation is in progress.

FIG. 9A is a cross-sectional view illustrating an exemplary internal structure of the printer body 31 while printing operation is halted, and FIG. 9B is a cross-sectional view while printing operation is in progress. As shown in FIG. 9A, the printer body 31 includes paper-feeding means 36 composed of a roller disposed above the leading edge portion of the paper tray 32 in the loading direction in the lower portion of the printer body 31 to supply recording paper 37 from the paper tray 32 as required. The printer body 31 further includes paper-separating means 38 disposed downstream of the feeding direction of the recording paper 37 to separate and supply individual sheets from the stack of recording paper 37 one by one, and a reversing roller 39 disposed in the upper portion of the printer body 31 downstream of the feeding direction of the recording paper 37 separated by the paper-separating means 38 so as to reverse the feeding direction of the recording paper 37.

Belt conveyor means 40 is disposed downstream of the feeding direction of the recording paper 37 reversed by the reversing roller 39. As shown in FIG. 9A while printing operation is halted, the end 40*a* downstream of the paper-feeding direction is lowered in the direction of an arrow F so as to produce a large gap between the end 40*a* and the bottom of the head cartridge 1. On the other hand, as shown in FIG. 9B while printing operation is in progress, the end 40*a* is lifted in the direction of an arrow G so as to place the belt conveyor means 40 in a horizontal position and to produce a predetermined small gap between the end 40*a* and the bottom of the head cartridge 1 as a recording-paper path.

As shown in FIG. 9A while the printing operation is halted, the bottom of the head cartridge 1 is closed with the head cap 41 to prevent the ink in the ink-ejecting nozzles from drying and clogging. The head cap 41 has cleaning means 42 that cleans the ink-ejecting nozzles before printing when the head cap 41 moves to a predetermined position (see FIG. 9B).

The operation of the ink-jet printer 30 having the above-described structure will now be described. First, as shown in FIG. 8, the top cover 34 disposed on the top of the printer body 31 is opened and the head cartridge 1 is accommodated in the storage unit 33 in the direction of the arrow Z. The paper tray 32 is loaded into the tray-loading slot 35 disposed in the lower front of the printer body 31. At this time, as shown in FIG. 9A, the end 40*a* of the belt conveyor means 40 is lowered in the direction of the arrow F, and the bottom of the head cartridge 1 is closed with the head cap 41.

When a control signal for printing is input, the head cap 41 moves to the predetermined position in the direction of an arrow H shown in FIG. 9A. During this movement of the head cap 41, the cleaning means 42 cleans the ink-ejecting nozzles by sliding on the nozzle plate 10 of the printhead 2 (see FIG. 1).

After the head cap 41 moves to the predetermined position, the end 40*a* of the belt conveyor means 40 is lifted in the direction of the arrow G shown in FIG. 9A, and the belt conveyor means 40 is placed in a horizontal position to produce the predetermined small gap between the conveyor belt and the head cartridge 1 as the recording-paper path (see FIG. 9B).

While the printing operation is in progress as shown in FIG. 9B, the paper-feeding means 36 is driven to supply the recording paper 37 stacked in the paper tray 32 in the direction of an arrow I. In this process, the paper-seperating means 38 separates and supplies individual sheets from the stack of recording paper 37 one by one in the direction of an arrow J as required.

The reversing roller 39 reverses the feeding direction of the supplied recording paper 37, and the recording paper 37 is sent to the belt conveyor means 40. The belt conveyor means 40 conveys the recording paper 37 to the lower portion of the head cartridge 1.

When the recording paper 37 reaches the lower portion of the head cartridge 1, a print signal is input to the printhead 2 to drive heating elements disposed therein. The ink drops 27 (see FIG. 5) are ejected from arrays of the ink-ejecting nozzles discharging four color inks toward the recording paper 37 that is conveyed at a constant speed to produce a color image on the recording paper 37.

When the printing to the recording paper 37 is finished, the recording paper 37 is conveyed from the lower portion of the head cartridge 1 in the direction of an arrow K shown in FIG. 9B, and is then output from the tray-loading slot 35 functioning as a paper-delivering slot (see FIG. 8) to the output tray 32*a* on the paper tray 32. Then, the end 40*a* of the belt conveyor means 40 is lowered in the direction of the arrow F shown in FIG. 9A, the head cap 41 closes the bottom of the head cartridge 1 to halt the printing operation, and the operation of the ink-jet printer 30 is halted.

Figure 8:
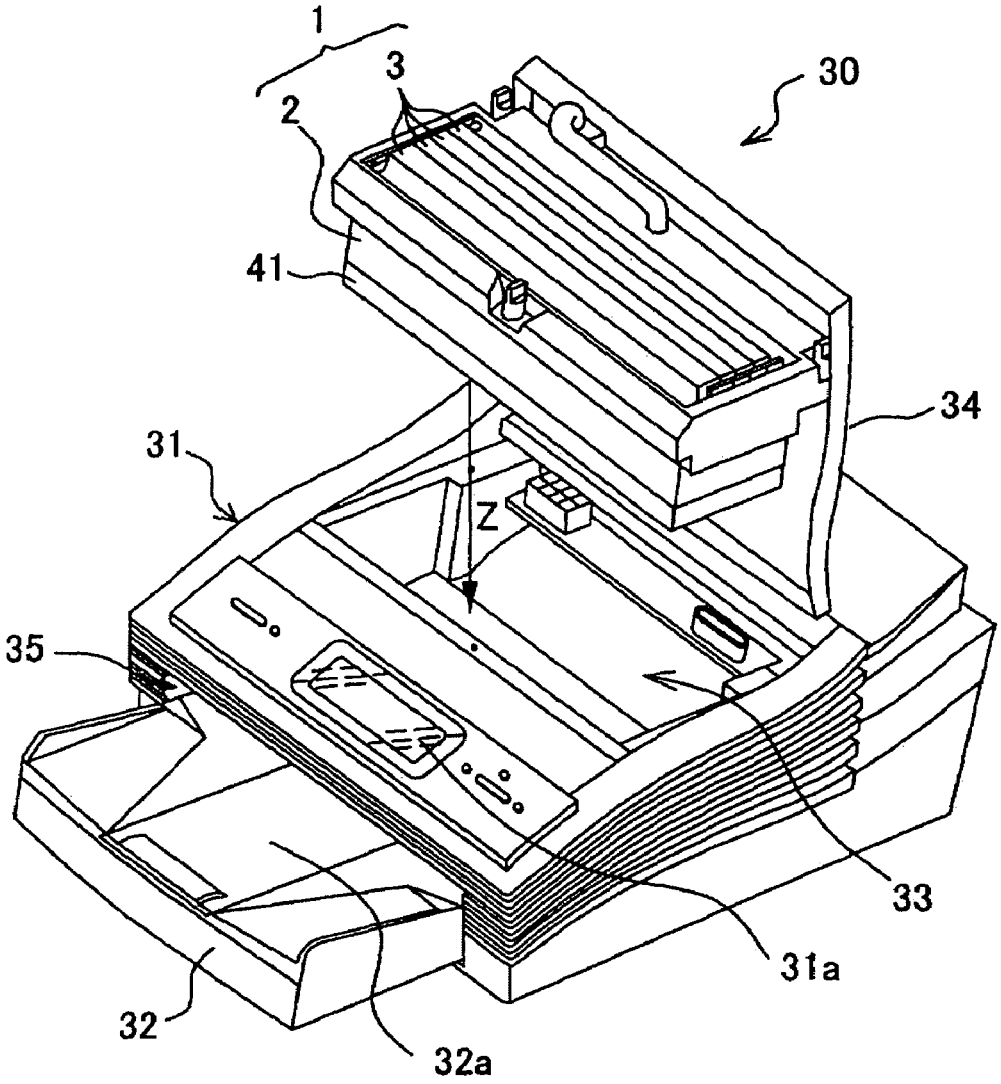
FIG. 8 is a perspective view illustrating an ink-jet printer as an example of a liquid-ejecting apparatus according to an embodiment of the present invention.

In FIGS. 8, 9A and 9B, the ink-jet printer 30 includes the head cartridge 1 that is detachable from the printer body 31. However, the printhead 2 may be provided in the printer body 31 without the head cartridge 1.

As stated above, the present invention is applicable to an ink-jet printer. However, the present invention is applicable to any apparatuses that eject liquid drops of predetermined liquid from liquid-ejecting nozzles. For example, the present invention is applicable to image-forming apparatuses such as ink-jet facsimiles and ink-jet duplicators.

Furthermore, the liquid ejected from the liquid-ejecting nozzles is not limited to ink. The present invention is applicable to any apparatuses that eject predetermined liquid by driving a liquid-ejecting head to produce a dot or a dot line. For example, the present invention is applicable to liquid-ejecting apparatuses that eject DNA-containing solution to culture plates for DNA identification, or that eject liquid containing conductive particles for patterning printed-circuit boards.

What is claimed is:

1. A head cartridge, comprising:

a liquid-ejecting head for ejecting a predetermined liquid from liquid-ejecting nozzles formed in a nozzle plate of the liquid-ejecting head, the liquid-ejecting head having a liquid chamber comprising a liquid inlet and at least two liquid outlets;

a liquid-supplying conduit for supplying the liquid from a single liquid tank to the liquid chamber in the liquid-ejecting head;

a valve unit including a valve and disposed on the liquid-supplying conduit;

a liquid-refluxing conduit for refluxing the liquid received from the liquid-ejecting head through the at least two liquid outlets to the liquid tank; and a liquid-circulating unit disposed only on the liquid-refluxing conduit and circulating the liquid between the liquid-ejecting head and the liquid tank, wherein, the liquid-circulating unit is driven to generate a negative pressure inside the liquid-ejecting head to circulate the liquid between the liquid-ejecting head and the liquid tank, and the valve unit supplies the liquid from the liquid tank to the liquid-ejecting head by opening the valve when a negative pressure is generated in the liquid-ejecting head.

2. The head cartridge according to claim 1, wherein the liquid tank is detachable from the liquid-ejecting head.

3. The head cartridge according to claim 1, wherein the liquid-circulating unit is a liquid-delivering pump.

4. The head cartridge according to claim 1, wherein the liquid-circulating unit is driven so as to generate a negative pressure that maintains a liquid meniscus formed in each of the liquid-ejecting nozzles in the liquid-ejecting head.

5. The head cartridge according to claim 1, further comprising:

a valve system disposed in the liquid-circulating unit, wherein the valve system prevents liquid backflow in the direction from the liquid-circulating unit to the liquid-ejecting head.

6. The head cartridge according to claim 1, further comprising:

a valve system disposed on the liquid-refluxing conduit, wherein the valve system prevents liquid backflow in the direction from the liquid-circulating unit to the liquid-ejecting head.

7. The head cartridge according to claim 1, wherein the liquid inlet is substantially in the center of the chamber and the at least two liquid outlets are at both ends.

8. The head cartridge according to claim 1, wherein the liquid inlet is at one end of the chamber and the at least two liquid outlets are at the other end.

9. A liquid-ejecting apparatus, comprising:

a head cartridge detachably disposed in the apparatus body, wherein, the head cartridge comprises a liquid-ejecting head for ejecting a predetermined liquid from liquid-ejecting nozzles formed in a nozzle plate of the liquid-ejecting head, the liquid-ejecting head having a liquid chamber comprising a liquid inlet and at least two liquid outlets;

a liquid-supplying conduit supplying the liquid from a single liquid tank to the liquid chamber in the liquid-ejecting head, a valve unit including a valve and disposed on the liquid-supplying conduit, a liquid-refluxing conduit for refluxing the liquid received from the liquid-ejecting head through the at least two liquid outlets to the liquid tank; and a liquid-circulating unit disposed only on the liquid-refluxing conduit and circulating the liquid between the liquid-ejecting head and the liquid tank;

wherein, the liquid-circulating unit is driven to generate a negative pressure inside the liquid-ejecting head to circulate the liquid between the liquid-ejecting head and the liquid tank;

the valve unit supplies the liquid from the liquid tank to the liquid-ejecting head by opening the valve when a negative pressure is generated in the liquid-ejecting head; and each of the liquid-ejecting nozzles formed in the liquid-ejecting head of the head cartridge ejects the predetermined liquid to produce a dot or a dot line.

10. The liquid-ejecting apparatus according to claim 9, wherein the liquid tank is detachable from the liquid-ejecting head.

11. The liquid-ejecting apparatus according to claim 9, wherein the liquid-circulating unit is a liquid-delivering pump.

12. The liquid-ejecting apparatus according to claim 9, wherein the liquid-circulating unit is driven so as to generate a negative pressure that maintains a liquid meniscus formed in each of the liquid-ejecting nozzles in the liquid-ejecting head.

13. The liquid-ejecting apparatus according to claim 9, further comprising:

a valve system disposed in the liquid-circulating unit, wherein the valve system prevents liquid backflow in the direction from the liquid-circulating unit to the liquid-ejecting head.

14. The liquid-ejecting apparatus according to claim 9, further comprising:

a valve system disposed on the liquid-refluxing conduit, wherein the valve system prevents liquid backflow in the direction from the liquid-circulating unit to the liquid-ejecting head.

15. The liquid-ejecting apparatus according to claim 9, wherein the liquid inlet is substantially in the center of the chamber and liquid outlets are at both ends.

16. The liquid-ejecting apparatus according to claim 9, wherein the liquid inlet is at one end of the chamber and the liquid outlets are at the other end.

17. A liquid-ejecting apparatus, comprising:

a liquid-ejecting head for ejecting a predetermined liquid from liquid-ejecting nozzles formed in a nozzle plate of the liquid-ejecting head, the liquid-ejecting head having a liquid chamber comprising a liquid inlet and at least two liquid outlets;

a valve unit including a valve and disposed on the liquid-supplying conduit;

a liquid-supplying conduit for supplying the liquid from a single liquid tank to the liquid chamber in the liquid-ejecting head;

a liquid-refluxing conduit for refluxing the liquid received from the liquid-ejecting head through the at least two liquid outlets to the liquid tank; and a liquid-circulating unit disposed only on the liquid-refluxing conduit and circulating the liquid between the liquid-ejecting head and the liquid tank, wherein, the liquid-circulating unit is driven to generate a negative pressure inside the liquid-ejecting head to circulate the liquid between the liquid-ejecting head and the liquid tank, and the valve unit supplies the liquid from the liquid tank to the liquid-ejecting head by opening the valve when a negative pressure is generated in the liquid-ejecting head.

18. The liquid-ejecting apparatus according to claim 17, wherein the liquid inlet is substantially in the center of the chamber and the at least two liquid outlets are at both ends.

19. The liquid-ejecting apparatus according to claim 17, wherein the liquid inlet is at one end of the chamber and the at least two liquid outlets are at the other end.

* * * * *